US010569443B2

(12) United States Patent
Roussel et al.

(10) Patent No.: US 10,569,443 B2
(45) Date of Patent: Feb. 25, 2020

(54) METHOD AND DEVICE FOR PLACING AN INSERT IN A CAVITY FORMED IN A FOIL

(71) Applicant: GEMALTO SA, Meudon (FR)

(72) Inventors: Francois Roussel, Meudon (FR); Joseph Leibenguth, Meudon (FR); Frederic Blanchon, Meudon (FR); Jean-Luc Lesur, Meudon (FR)

(73) Assignee: Thales Dis France SA, Meudon (FR)

( * ) Notice: Subject to any disclaimer, the term of this patent is extended or adjusted under 35 U.S.C. 154(b) by 590 days.

(21) Appl. No.: 15/104,916

(22) PCT Filed: Dec. 3, 2014

(86) PCT No.: PCT/EP2014/076342
§ 371 (c)(1),
(2) Date: Jun. 15, 2016

(87) PCT Pub. No.: WO2015/090956
PCT Pub. Date: Jun. 25, 2015

(65) Prior Publication Data

US 2016/0318203 A1 Nov. 3, 2016

(30) Foreign Application Priority Data

Dec. 17, 2013 (EP) ..... 13306748

(51) Int. Cl.
*B26D 7/27* (2006.01)
*B26D 7/18* (2006.01)
*B26F 1/40* (2006.01)

(52) U.S. Cl.
CPC ..... *B26D 7/27* (2013.01); *B26D 7/1818* (2013.01); *B26D 7/1854* (2013.01); *B26F 1/40* (2013.01)

(58) Field of Classification Search
CPC ..... B23Q 1/262; B23Q 1/48; B41F 15/18; H05K 13/0015; H05K 2203/0165; H05K 2203/166; H05K 3/10; H05K 3/1233
See application file for complete search history.

(56) References Cited

U.S. PATENT DOCUMENTS 4,543,865 A * 10/1985 Kramski ..... B21D 28/145 83/146
4,805,280 A * 2/1989 Elander ..... B21D 39/03 29/432

(Continued)

FOREIGN PATENT DOCUMENTS

GB 2267247 A 12/1993

OTHER PUBLICATIONS

PCT/EP2014/076342 International Search Report, Feb. 27, 2015, European Patent Office, P.B.5818 Patentlaan 2, NL—2280 HV Rijswijk.

(Continued)

*Primary Examiner* — Minh N Trinh
(74) *Attorney, Agent, or Firm* — The Jansson Firm; Pehr B. Jansson

(57) ABSTRACT

To place an insert cut out of film with no gaps in a cavity formed in a foil, after placing the foil on a supporting substrate, the cavity is punched into the foil by means of a tubular cutting punch comprising an inner pusher with a cutting edge in the required shaped of the cavity and the insert, so that the edge goes through the thickness of the foil and cuts a slug out of it; the punch is lifted with the slug held inside the punch, without moving the foil, the film is brought between the foil and the edge of the punch, the punch is lowered once again so as to cut the insert out of the film and then push the insert cut in that way in the cavity with a (Continued)

pusher, and the punch and the pusher are removed, with the insert held in place in the cavity.

6 Claims, 2 Drawing Sheets

(56) References Cited

U.S. PATENT DOCUMENTS

| | | | | |
|---|---|---|---|---|
| 4,823,660 | A | 4/1989 | Forthmann | |
| 5,203,060 | A * | 4/1993 | Mraz | B29C 45/14221 264/155 |
| 5,349,890 | A * | 9/1994 | Butkus | B26D 7/10 83/171 |
| 9,364,884 | B1 * | 6/2016 | Cooper, Jr. | B21D 28/145 |
| 9,980,404 | B2 * | 5/2018 | Fidalgo | G06K 19/0718 |
| 2003/0024636 | A1 | 2/2003 | Lin | |
| 2016/0318203 | A1 * | 11/2016 | Roussel | B26D 7/1818 |

OTHER PUBLICATIONS

PCT/EP2014/076342 Written Opinion of the International Searching Authority, Feb. 27, 2015, European Patent Office, P.B.5818 Patentlaan 2, NL—2280 HV Rijswijk.

* cited by examiner

METHOD AND DEVICE FOR PLACING AN INSERT IN A CAVITY FORMED IN A FOIL

BACKGROUND

1. Field of the Invention

This invention relates to a new method and a new device for putting in place an insert in a cavity formed in a foil product, typically with thickness below 2 mm, particularly below 300 μm.

2. Description of the Related Art

The invention is particularly but not exclusively related to the area of printed circuit boards or smart cards or other fine documents in plastic material, typically in polycarbonate and possibly containing one or more electronic circuits, such as for example a data page used in some passports. In the area of smart cards, the difficulties encountered by card manufacturers to insert the electronic modules of such cards in the card bodies with as small a gap as possible between said module and its slot formed in a layer making up the card body are well known. More recently, the problem of putting in place different inserts such as transparent inserts that may or may not carry information printed or engraved on one of their sides in the thickness of the card body has also arisen; such inserts are intended to be placed inside the card, and the transparency of the material of the insert allows visual access to said information and generally provides additional security from copying. Such information may for example be an image, a photograph or information that can only be read by a special reader, for example printing by means of laser-sensitive ink etc. The insert may also comprise an active or passive electronic device, such as a microchip, an RFID antenna etc.

In general, the aim is that the inserted functional element, carried in the insert itself, is to be integrated in the thickness of the finished card, with no space between the perimeter of the insert and the cavity formed in the receiving card body.

Current techniques for putting in place such an insert in the cavity that makes up the slot consist firstly in cutting out the inserts and secondly in making cavities in the card body; these operations are carried out by moulding, machining, laser cutting or punching. After that, each insert is placed in its cavity using high-precision robotised multiple-axis machines to allow the exact positioning of each insert opposite its cavity; most of these machines are further equipped with an assisted vision control system.

The difficulty with such insertion is great, particularly due to the fine thickness of the layer, currently in polycarbonate, in which the cavity is formed, and the fine thickness of the insert, with thickness values that may be only about 50 μm, or even less. In spite of the sophistication of the machines used, the gap between the insert and the cavity cannot be reduced to below 0.05 to 0.10 mm.

This invention is aimed firstly at entirely eliminating that gap and secondly at reducing the complexity of the machinery used at present, thus reducing the manufacturing costs of cards or similar fine products comprising inserts.

SUMMARY OF THE INVENTION

With these objectives in mind, the invention is aimed at a method for putting in place an insert in a cavity formed in a foil product, where the insert is cut out of film and then placed in said cavity.

According to the invention, the method is characterised in that, after the foil is placed on a support surface, the following sequences of steps is carried out:

a) the cavity is made by punching the foil by means of a tubular cutting punch comprising an inner pusher, with a cutting edge in the shape to be given to the cavity and the insert, wherein the punch is lowered orthogonally to the foil, so that its edge goes through the thickness of the foil and cuts a slug out of it, b) the punch is lifted with the slug held inside the punch, so as to clear a space between the top side of the foil and the punch that is sufficient for placing the film, c) without moving the foil, the film is brought between the foil and the edge of the punch, with the film set against the foil, d) the punch is lowered once again so as to cut the insert out of the film and then push the insert cut in this way into the cavity with a pusher, e) the punch is removed, then the pusher, with the insert held in place in the cavity.

In step (d), the insert is cut exactly in the same shape and same dimensions as the cavity, since the two cuts are made successively by the same punch. Further, because there is no displacement transversal to the centre line of the punch of the foil in which the cavity is cut in relation to said punch between the step of cutting the cavity and the step of cutting the insert, the exact position of the insert in relation to the receiving cavity is achieved automatically without any need for high-precision mechanisms or assisted-vision and control means.

Thus, thanks to the invention, it is possible to put in place an insert in a cavity very precisely, with no peripheral gap between the insert and the cavity, and with no necessity for costly investment in high-precision equipment and machinery.

In a preferable arrangement for the application of the method on the industrial scale, the following step is carried out after step (e) in order to put in place several inserts in their respective cavities:

f) without moving the film, the foil and its support are moved to bring a new cavity cutting area opposite the punch, then the sequence of steps (a) to (f) is resumed, and the punch passes, in step (a), in the hole formed in the film when the insert is cut in step (d).

During such industrial application, a preliminary step is carried out during the first cycle, consisting in cutting a first insert out of the film to obtain the hole required to pass the punch during step (a); the first insert is then removed without being used.

The slug may be cleared out of the punch between the step (b) and the step (d), so that the pusher acts directly on the insert during step (d) to push the insert into the cavity.

However, in a preferable mode of implementation, when the punch is raised in step (b), the slug is held inside the punch and acts as an intermediate piece between the pusher and the insert, to push the insert in its cavity during the step (e).

Equally preferably, the slug is held inside the punch by vacuum against the pusher, as this mode of holding makes it possible to make sure that the slug remains in place against the front wall of the pusher, during the steps when it acts as an intermediate piece to press the insert into the bottom of its cavity, till it is ejected outside the punch.

In the preferable mode of implementation, the slug is ejected out of the punch and removed after the step (e); the operation of ejecting and removing the slug cut out of the foil can then be carried out while the foil and support move in step (f), which makes it possible to reduce the cycle time.

According to a particular arrangement, particularly when the foil and insert are fine, the support surface of the foil is made up of a support substrate that is associated with the foil in a fixed manner, and said substrate and foil thus move simultaneously and may be joined by lamination. Such an arrangement particularly applies in the case of the implementation of the invention for manufacturing smart cards or the like with fine foil, for example less than 100 μm thick. In the case of thicker foils or inserts, it is possible to not use a support substrate. That is because the precise fit of the insert in the cavity will allow the insert to be adequately blocked and held by its edges in the cavity, allowing minimum manipulation of the foil with the inserts, before moving on to a subsequent step of assembling the different layers, particularly comprising said foil, and together forming the card body, then laminating these layers to make the card body including the insert.

When the method is implemented using the support substrate joined to the foil, during the step (d), the pusher presses the insert into the bottom of the cavity, against the support substrate, so as to make the insert bond with said substrate, under the sole effect of the face-to-face contact between the insert and the support substrate. To facilitate and reinforce such bonding, the step (d) may be carried out by warming up the materials, particularly of the insert, to make it more adhesive and/or provide heat through the pusher, which may to that end comprise heating means.

For putting in place inserts in the cards, particularly smart cards comprising the assembly of a substrate element and a foil element of the same dimension, the support substrate and the foil have a transverse dimension determined to form a plurality of cards, and the different steps are carried out simultaneously on as many stations for cutting and putting in place the inserts, distributed along the transverse direction. Alternatively, a number of stations for cutting and putting in place inserts smaller than the number of cards distributed transversally may be used, preferably in a submultiple of the number of cards, and the stations for cutting and putting in place are displaced in the transverse direction. Regardless of the case, the film is preferably a strip out of which only one insert is cut along the width, where each station for cutting and putting in place is supplied with that strip independently of the other stations. Alternatively, a wide film may also be used, for example of the same width as the support substrate and the foil, and all the stations for cutting and putting in place may be supplied simultaneously to simultaneously cut and put in place the inserts of all the card bodies distributed along that width. Thus, the method according to the invention makes it possible, thanks to the absence of the need for very high precision in positioning the inserts in relation to the corresponding cavities, to carry out the cutting and insertion operations in a particularly fast and economical manner, while ensuring that there is no peripheral gap between the inserts and the cavities.

The invention is also aimed at a device for putting in place an insert cut out of film in a cavity formed in a foil, in accordance with the method described above, wherein the device comprises:

at least one assembly for cutting and placing comprising a tubular cutting punch that moves in the axial direction and a pusher that slides inside the punch, supply means to supply the foil on a support table, displacement means to displace the foil before the punch, perpendicular to the centre line of the punch, second supply and feed means to supply the film between the punch and the foil and to displace the film independently from the displacement of the foil, control means to control, in a coordinated manner, the displacements of the punch and the pusher and the displacements of the foil and the film.

In one particular arrangement, the device comprises third supply means to supply a support substrate, in a coordinated manner with the supply of the foil, wherein the displacement means are arranged to simultaneously displace the assembly made up of the substrate and the foil applied on said substrate.

In complementary and or preferable arrangements:

the pusher comprises holding means to temporarily hold a slug cut by the punch inside the punch, said holding means comprise vacuum holes formed in the pusher that open out onto its front side, the pusher comprises heating means.

BRIEF DESCRIPTION OF THE DRAWINGS

Other characteristics and benefits will become clear in the description below provided as a non-limitative example, of a machine according to the invention for manufacturing smart cards comprising inserts, and the method for implementation.

Reference will be made to the attached drawings, where.

DETAILED DESCRIPTION

Said head 10 is mounted on a mobile carriage that moves on frame 11, transversal to direction F of the displacement of the substrate 1 and the associated foil 2

Figure 1:
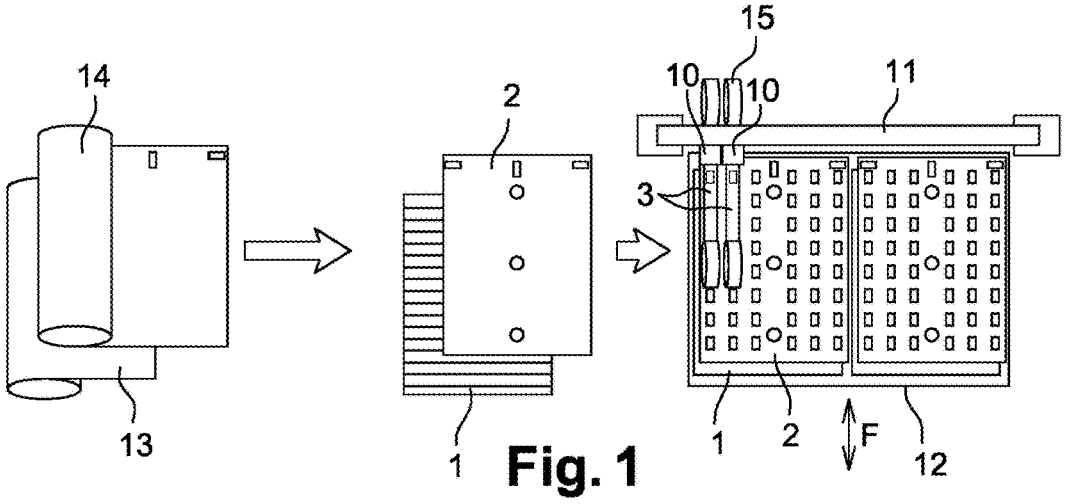
FIG. 1 is a perspective view of the machine according to the invention.

The machine represented in FIG. 1 comprises two insert cutting and placing heads 10 mounted on a mobile carriage that moves on a frame 11, and can be moved transversally to the direction F of displacement of a table 12 that can be displaced under the frame. Each head comprises a punch 50 and a pusher 51, visible in FIG. 2 and the following figures. The machine comprises first supply means 13 to supply a support substrate 1 and deposit it on the table 12 and second supply means 14 to supply the foil 2 that is to receive the inserts and place said foil on the substrate.

In the example of implementation illustrated in FIG. 1, the film out of which the inserts are cut takes the form of a rolled strip 3, in the width of which only one insert 30 is cut, and each head 10 also comprises means 15 for feeding said strip 3.

In the example presented, the substrate 1 and the film 2 are deposited on the table 12 in the form of two assemblies, each comprising a substrate 1 and a foil 2, pre-cut in rectangular shapes and pre-assembled in a manner known in itself, the dimensions of which are determined to make 48 card bodies in each assembly of substrate 1 and foil 2. Of course, any other format could be used as required.

The substrate 1 is typically a plate of opaque polycarbonate, for example white polycarbonate, that is 100 μm thick, and the foil 2 is 50 μm opaque polycarbonate; these thicknesses are given for guidance only and are not limitative in any way.

The fine strip 3 out of which the inserts 30 are cut is formed by a transparent polycarbonate film with, on one side, coating 31 that could have any pattern that is to be integrated but visible in the thickness of the card body after the insert is put in place. However, the invention may be implemented with other types of insert, in other materials, transparent or otherwise, to carry out other functions, for example to integrate an RFID antenna in the card body. The thickness of the strip 3 and therefore that of the insert and its printing, are typically the same as that of the foil 2, but it may also be different, particularly smaller. In general, the aim is to place, after the insert 30 is put in place, one or more additional protective layers on the foil, where all the layers, substrate, foil with insert and other protective sheets are laminated together later on to make up the body of the finished card.

Each assembly 10 for cutting and placing inserts comprises a tubular cutting punch 50 that moves in the axial direction and a pusher 51 that slides inside the punch. The inner section of the tubular punch has a shape and dimensions identical to those of the insert 30 to put in place and thus the cavity 21 to be made. The lower end of the punch makes up the bevelled cutting edge 52 in a manner known in itself. The displacement of the pusher 51 is guided inside the punch 50 along the axial direction; that pusher 51 comprises through vacuum conduits 53 that open out on the front 54 of the pusher 51, connected by their other ends to a vacuum unit that is not represented.

In relation with FIGS. 2 to 10, the different insert cutting and placing steps will now be explained, it being understood that all these steps are repeated for each card body, but these steps may be synchronised for several cutting and placing assemblies implemented in the same machine.

Figure 2:
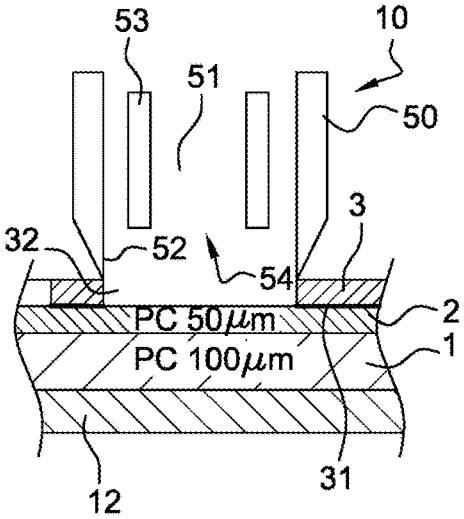
FIG. 2 represents the device according to the invention in the initial position of a cycle of implementation of the method according to the invention.

FIG. 2 represents the device at the start of the cycle, where the support substrate 1 is placed on the table 12 and the foil 2 placed on the substrate 1, where the punch 50 is in the raised position, and where its edge 52 is aligned with the hole 32 made earlier by cutting an insert 30 out of the strip 3. The pusher 51 is also in the raised position. It must be noted that at the start of a sequence of insert placing operations, a preliminary step is carried out to cut a first insert out of the strip 3, making it possible to obtain the hole 32 required to pass the punch 50 in the first step, where the first insert is then removed without being used.

Figure 3:
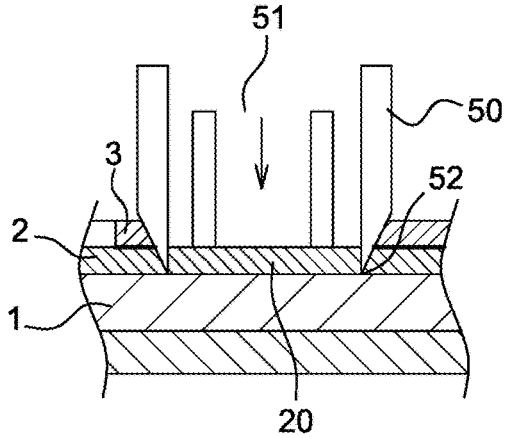
FIGS. 3 to 10 represent the device according to the invention in the following sequence of steps (b) to (g) respectively of the method according to the invention.

During the first step (a) represented in FIG. 3, the punch 50 is lowered and passed through the hole 32 created by cutting out an insert in the previous cycle or the preliminary step. The punch 50 is lowered till its edge 52 reaches the surface of the support substrate 1, having thus cut a slug 20 out of the foil 2, with a shape and dimensions exactly identical to those of the edge of the punch. The pusher 51 is simultaneously brought in contact with that slug and the vacuum through the conduits 53 holds the slug 20 against the front surface of the pusher.

Figure 4:
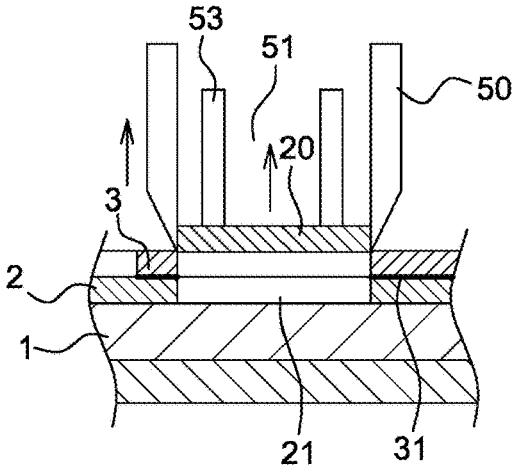

In the second step (b) represented in FIG. 4, the punch 50 and the pusher 51 are simultaneously lifted over a sufficient distance so that the strip 3 can slide between the punch and the foil 2, that is to say a distance at least equal to the sum of the thicknesses of the foil 2 and the strip 3. As that punch goes up, the pusher 51 holds the slug 20 inside the body of the punch.

Figure 5:
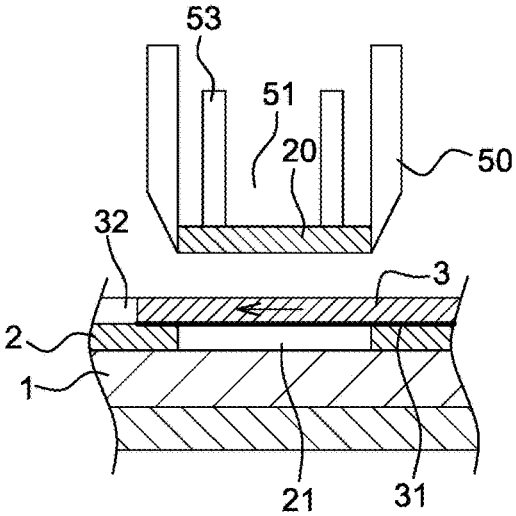

During the third step (c) represented in FIG. 5, the strip 3 is slipped between the punch 50 and the foil 2 till the zone corresponding to the insert to cut is brought right below the punch. While the strip is being displaced in that way, the punch removes immobile, as do the substrate and the foil.

Figure 6:
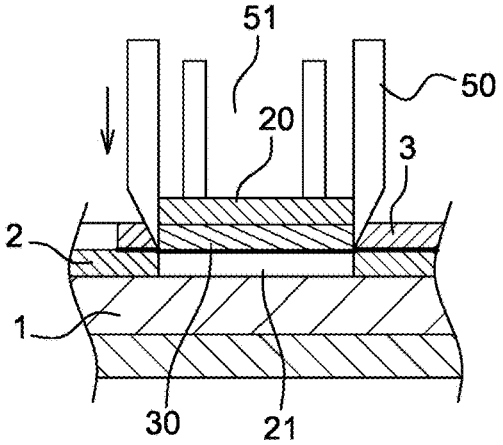
Figure 7:
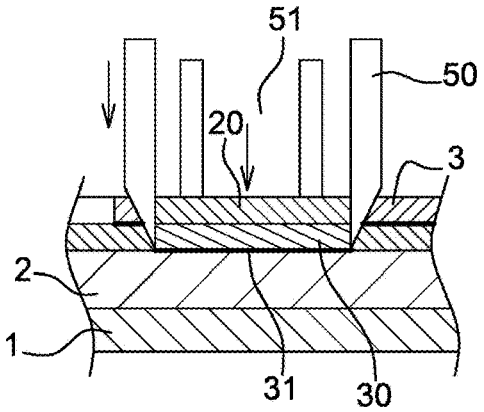

During the fourth step (d), in a first stage, represented in FIG. 6, the punch 50 is lowered to cut the insert 30 out of the strip 3, the pusher 51 is held back to not press on the insert being cut, then, in a second stage, represented in FIG. 7, the punch 50 continues its descent over a distance without reaching the substrate 1 and simultaneously the pusher 51 makes the cut insert 30 enter into the cavity 21 of the foil 2 cleared earlier, and the slug 20 acts as the intermediary between the pusher and the insert during such insertion. Under the effect of the pressure applied at the end of the travel, the insert 30 bonds with the side of the substrate 1 that makes up the bottom of the cavity 21. As stated already, as the insert 30 is cut by the same tool that forms the cavity 21 in the foil during the previous stage, without moving the foil 2 in relation to the punch 50, that ensures that the insert 30, with exactly the same dimensions as the slug 20 cut earlier, is inserted precisely with no perimeter gap.

Figure 8:
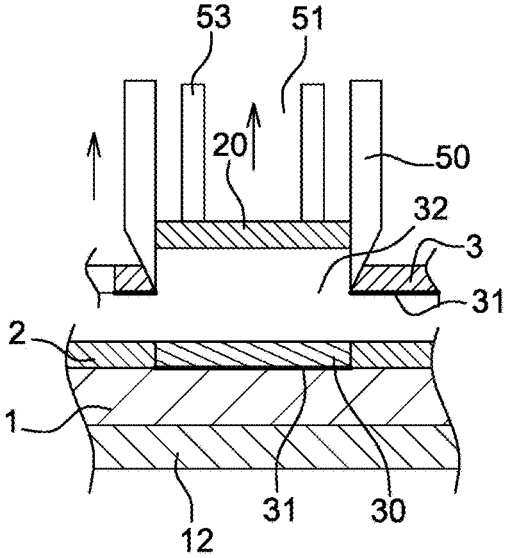
Figure 9:
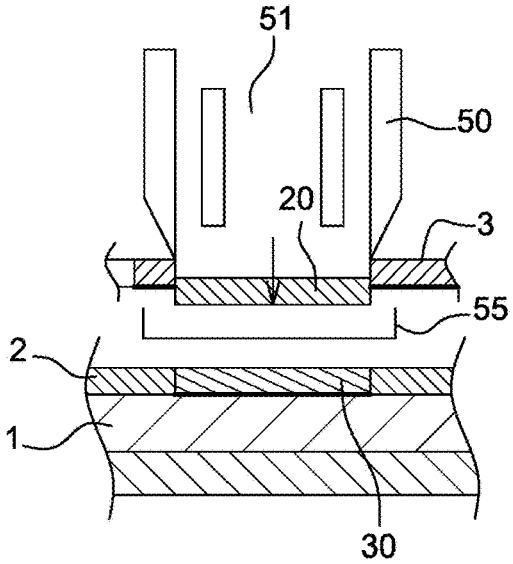

During the fifth step (e), represented in FIG. 8, the punch 50 and then the pusher 51 are lifted, taking away the slug 20, which is still held by vacuum; the insert 30 remains held in the cavity 21 of the foil 2.

The slug 20 can then be ejected out of the punch, by stopping the vacuum in the pusher and blowing air in the reverse direction through the holes of the pusher, and collected in a collector 55 for removal.

Figure 10:
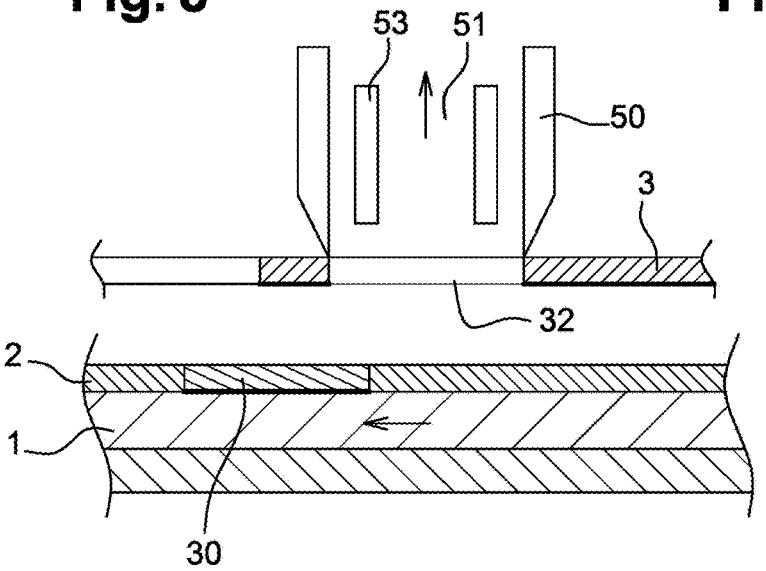

Lastly, during the step (f), represented in FIG. 10, the substrate 1 and the foil 2 are moved to bring the next location for putting in place an insert in front of the punch 50, with a return to the position of FIG. 2, to restart another cycle of cutting and putting in place another insert. It must be noted that the slug 20 may be collected and removed while the substrate and the foil are being displaced, thus reducing the total cycle time.

The invention is not limited to the embodiment and application described above only as an example. In particular, the invention may be used to place many types of insert, such as a transparent display window, an electronic module, a printed circuit, a screen, an element in material or colour other than those of the foil etc. in a cavity formed in said foil with no gap between the insert and the cavity. The foil may be assembled with the support substrate prior to installation on the table. The film in which the inserts are cut may also be, not a simple strip, but a wide film, for example of the same width as the foil, common to all cutting heads. Several layers of sheet material can be placed under the foil receiving the insert and one or more layers may also be placed above the foil after placing the insert. The invention is particularly intended for putting in place inserts in cards such as smart cards, bank cards, identification cards etc. that is to say typically cards in polycarbonate that at less than 1 mm thick. It may also be used for putting in place inserts in fine documents made of plastic material, typically polycarbonate, such as for example a data page used in some passports or for products in thicker sheet material, for example up to two mm or even more, and in other plastic materials or other materials.

The invention claimed is:

1. A method for placing an insert in a cavity formed in a foil having a top side, where the insert is cut out of film and then placed in said cavity, comprising:

providing a tubular cutting punch having an inner pusher and a cutting edge having a shape to be given to the cavity and the insert;

providing the foil;

providing the film;

providing a support surface;

placing the foil on the support surface;

placing the insert in the cavity formed in the foil by performing the following sequence order steps of:

a) making the cavity by punching the foil using the tubular cutting punch by lowering the punch orthogonally to the foil, so that the cutting edge goes through the foil and thereby cuts a slug out of the foil;

b) lifting the punch with the slug held inside the punch, so as to clear a space between the top side of the foil and the cutting edge of the punch that is sufficient for placing the film between the top side of the foil and the cutting edge of the punch;

c) without moving the foil, placing the film between the foil and the cutting edge of the punch, with the film set against the foil;

d) forming the insert by punching the film by lowering the punch again orthogonally to the film so as to cut the insert out of the film, thereby producing the insert, and then pushing the insert into the cavity using the inner pusher;

e) removing the punch, then the inner pusher while holding the insert in place in the cavity.

2. The method according to claim 1, after the step (e), further comprising:

f) without moving the film, moving the foil to bring a new cavity cutting area opposite the punch, then resuming the sequence of steps (a) to (f), and passing the punch, in step (a), through the hole formed in the film when the insert is cut in step (d).

3. The method according to claim 1, wherein the step (b) lifting the punch further comprises holding the slug inside the punch, as an intermediate part located between the pusher and the insert, such that the slug pushes the insert into the cavity during the step (e).

4. The method according to claim 3, wherein the holding the slug inside the punch comprises holding the slug inside the punch by a vacuum against the pusher.

5. The method according to claim 4, further comprising ejecting the slug out of the punch and removing the slug.

6. The method according to claim 1 wherein the placing the foil on the support surface further comprising fixing the foil to the support surface, wherein the support surface is a support substrate.

* * * * *